US006923384B2

(12) United States Patent
Cernik

(10) Patent No.: US 6,923,384 B2
(45) Date of Patent: Aug. 2, 2005

(54) APPARATUS FOR DISPENSING A LIQUID ADDITIVE TO SHOWER WATER

(76) Inventor: Julie A. Cernik, 559 County Road C, Ashland, NE (US) 68003

( * ) Notice: Subject to any disclaimer, the term of this patent is extended or adjusted under 35 U.S.C. 154(b) by 395 days.

(21) Appl. No.: 10/117,072

(22) Filed: Apr. 8, 2002

(65) Prior Publication Data

US 2003/0189106 A1 Oct. 9, 2003

(51) Int. Cl.[7] ..... B05B 7/30

(52) U.S. Cl. ..... 239/318; 239/337; 239/365; 4/605; 4/903

(58) Field of Search ..... 239/310, 317, 239/318, 365, 373, 337; 4/903, 605, 559, 597, 546

(56) References Cited

U.S. PATENT DOCUMENTS

| | | | | | |
|---|---|---|---|---|---|
| 1,847,869 | A | * | 3/1932 | Fawcett | 239/314 |
| 2,105,690 | A | | 1/1938 | Greenblatt | 99/78 |
| 2,602,697 | A | | 7/1952 | Otto et al. | 299/84 |
| 2,609,232 | A | | 9/1952 | Taulman | 299/84 |
| 2,891,732 | A | | 6/1959 | Orter et al. | 239/322 |
| 3,083,915 | A | | 4/1963 | Grauel | |
| 3,106,345 | A | | 10/1963 | Wukowitz | |
| 3,198,437 | A | * | 8/1965 | Faglie | 239/309 |
| 3,207,445 | A | | 9/1965 | Court et al. | |
| 3,231,200 | A | | 1/1966 | Heald | |
| 3,409,230 | A | * | 11/1968 | Eelkema | 239/314 |
| 3,486,695 | A | | 12/1969 | Novak | |
| 3,526,316 | A | | 9/1970 | Kalogris | |
| 3,539,111 | A | | 11/1970 | Johnson | |
| 3,628,732 | A | | 12/1971 | Vicari | |
| 3,763,888 | A | | 10/1973 | Duecker | |
| 3,764,074 | A | | 10/1973 | James | |
| 3,797,747 | A | | 3/1974 | Buzzi et al. | |
| 3,813,072 | A | * | 5/1974 | Moore | 248/313 |
| 3,847,354 | A | | 11/1974 | Lemond | |
| 3,907,203 | A | * | 9/1975 | Skillings | 239/314 |
| 4,031,238 | A | | 6/1977 | Reid et al. | |
| 4,099,672 | A | | 7/1978 | Sheahan et al. | |
| 4,121,773 | A | | 10/1978 | Headen et al. | |
| 4,131,232 | A | * | 12/1978 | Pollinzi | 239/314 |
| 4,189,100 | A | | 2/1980 | Karp | |
| 4,193,520 | A | | 3/1980 | Duffield | |
| 4,200,206 | A | | 4/1980 | Chase et al. | |
| 4,218,013 | A | | 8/1980 | Davison | |
| 4,294,280 | A | | 10/1981 | Tom | |
| 4,322,036 | A | | 3/1982 | Bly | |
| 4,384,005 | A | | 5/1983 | McSweeney | |
| 4,414,198 | A | | 11/1983 | Michaelson | |
| 4,432,105 | A | | 2/1984 | Pitroda | |
| 4,467,964 | A | | 8/1984 | Kaeser | |

(Continued)

OTHER PUBLICATIONS

Durtschi, Al, "Coghlan's Emergency Drinking Water Germicidal Tablets," Aug. 11, 1998, www.waltonfeed.com.
"Replenish and energize with HangOv . . . ," www.efferpower.com.
"Object: water sterilizing tablet," www.hants.gov.uk/museums.
"Sugar–Coated Tablet," (JP11116467A2), www.patents.ibm.com.

*Primary Examiner*—Dinh Q. Nguyen
(74) *Attorney, Agent, or Firm*—Thome, Mazour & Niebergall; Shane M. Niebergall

(57) ABSTRACT

A liquid additive dispensing apparatus for dispensing a liquid additive into, above or adjacent to a shower stream emitted from a shower head including an additive reservoir, an additive dispensing conduit, with a valve, which extends from a lower portion of the additive reservoir, and a support having proximal and distal portions. The proximal portion of the support includes a mount adapted for mounting the support to a shower structure, such as the water supply pipe, shower head, a wall, or a curtain rod, and the distal portion is attached to the additive reservoir.

21 Claims, 2 Drawing Sheets

U.S. PATENT DOCUMENTS

| | | | |
|---|---|---|---|
| 4,508,740 | A | 4/1985 | McSweeney |
| 4,607,793 | A | 8/1986 | Eberle |
| 4,623,095 | A | 11/1986 | Pronk |
| 4,651,930 | A | 3/1987 | Magaha, Jr. |
| 4,840,311 | A | 6/1989 | Shamblin |
| 4,874,606 | A | 10/1989 | Boyle et al. |
| 4,956,883 | A | 9/1990 | Lane |
| 5,071,070 | A | 12/1991 | Hardy |
| 5,135,173 | A | 8/1992 | Cho |
| 5,254,355 | A | 10/1993 | Smith et al. |
| 5,274,858 | A | 1/1994 | Berry |
| 5,333,789 | A | 8/1994 | Garneys |
| 5,356,076 | A | 10/1994 | Bishop |
| 5,454,516 | A | 10/1995 | Smyrl |
| 5,562,248 | A | 10/1996 | Khalifka |
| 5,562,941 | A | 10/1996 | Levy |
| 5,662,808 | A | 9/1997 | Blaney et al. |
| 6,039,987 | A | 3/2000 | Strahl |
| 6,045,060 | A | 4/2000 | Hudson |

* cited by examiner

APPARATUS FOR DISPENSING A LIQUID ADDITIVE TO SHOWER WATER

BACKGROUND OF THE INVENTION

1. Field of the Invention

The present invention relates to dispensers for the shower, and more particularly to an apparatus adapted for dispensing a liquid additive into, above or adjacent to a shower stream emitted from a shower head. The invention does not require retro-fitting or other modification of the existing plumbing installation.

2. Description of Background Art

The art of mixing soap with shower water includes many devices which provide means for mixing soap into the shower water before it is emitted from the shower head. Most of these devices make use of venturi effect or siphonic action to effect the mixing of liquid soap with the shower water before it flows through the primary, or in some instances an auxiliary, shower head. One such device is described in U.S. Pat. No. 5,562,248 issued to Khalifka. Other such devices are described in U.S. Pat. No. 6,045,060 issued to Hudson, U.S. Pat. No. 5,356,076 issued to Bishop, U.S. Pat. No. 4,623,095 issued to Pronk, and U.S. Pat. No. 4,432,105 issued to Pitroda.

The problems with such devices, as those referred to above, center around the need to retro-fit or modify the existing plumbing installations. Such an installation is time-consuming and difficult, and may require access to plumbing inside a wall or other building structure. Furthermore, devices which mix soap with shower water before it exits the shower head are not designed for the independent dispensing of soap. Another disadvantage of such devices is the fact that the additives selected to be mixed into the source water supply are often viscous. This can lead to the clogging of internal valve systems of the devices or the relatively small exit holes of the shower head, necessitating inconvenient cleaning, which discourage people from utilizing these devices. A further problem with certain of these devices, such as U.S. Pat. No. 5,356,076, derives from the need to divert all or a portion of the source water supply into a secondary flow, thus reducing the primary shower stream pressure and volume.

Other approaches to mixing soap with shower water include U.S. Pat. No. 4,956,883 issued to Lane which shows a dispenser apparatus in fluid communication with the source water supply and an auxiliary shower head. A portion of the source water must be diverted to mix with the soap, and the soapy water is then emitted through the auxiliary shower head. This device has problems common to the devices discussed above in that it requires retro-fitting of the existing plumbing and diversion of the source water flow, thus reducing the pressure through the primary shower head.

Yet another approach is described in U.S. Pat. No. 5,274,858 issued to Berry, in which solid cake soap is held between two screens in the shower water flowing from the primary shower head. The water flow passes into the input end of the apparatus, thereby dissolving the cake of soap, and out the output end of the apparatus. In this situation, the flow of shower water is impeded by the screens and the cake soap. Moreover, the design of the unit requires that only cake soap be used, and not liquid soap, nor does it permit mixing of other liquid additives with shower water from the shower head.

Another example of a related device is described in U.S. Pat. No. 2,891,732 issued to Orter et al., in which the source water supply is diverted to a soap dispensing device where the source water supply pressure causes soap to be squeezed out of the device. With this device, the entire source water supply is diverted to the soap dispenser and thus the soap is not mixed in the shower water.

Accordingly, many of the current devices for the dispensing and mixing of liquid additives with shower water require retro-fitting or modifying the existing plumbing installation thus diverting or otherwise interfering with the flow of shower water to the shower head. Moreover, current apparatus require mixing of liquid soap, or such, with the source water supply before it exits the shower head, and can thereby lead to back pressure problems or the clogging of internal valves and the relatively small exit holes of the shower head, thus necessitating frequent cleaning and discouraging use of the current devices.

Therefore, there remains a need in the art for improvements in liquid additive dispensers for use in the shower.

SUMMARY OF THE INVENTION

Accordingly, the present invention has one or more of the following objects:

- to provide a liquid additive dispensing apparatus adapted for dispensing liquid soap, bath gel, bath oil, shampoo, or the like, into, above or adjacent to shower stream emitted from a shower head, without the need for diversion of the source water supply, such that the liquid additive first mixes with the shower water downstream of the shower head;
- to provide such apparatus which permits the dispensing of liquid additive by gravity feed alone;
- to provide such apparatus in forms which are not integrated with the shower head and which do not require retro-fitting or otherwise modifying existing plumbing installations;
- to provide such apparatus in forms which are flexible enough to be used with any shower head or hand held unit;
- to provide such an apparatus with means to independently dispense the liquid additive, without turning on the shower water, and which do not require a mixing chamber for mixing the liquid additive with the shower water;
- to provide such apparatus in versions which allow the storage therein and dispensing of multiple liquid soaps, bath gels, bath oils, shampoos, or other liquid additives;
- to provide such a device which avoids clogging of exit holes of the primary or auxiliary shower head with the additive;
- to provide such an apparatus which can function in conjunction with a wide range of source water supply pressures and volume rates;
- to provide such an apparatus which may be separate from the plumbing installation and portable.

The liquid additive dispensing apparatus according to the present invention includes an additive reservoir with an upper portion and a lower portion, an additive dispensing conduit, with a valve, which extends from the lower portion of the additive reservoir, and a support having proximal and distal portions. The proximal portion of the support includes a mount adapted for mounting the support to a shower structure and the distal portion is attached to the additive reservoir.

The above and other objects, features and advantages of the present invention will become clear from the following description of the embodiments thereof, taken in conjunction with the accompanying drawings.

DETAILED DESCRIPTION OF THE PREFERRED EMBODIMENTS

Figure 1:
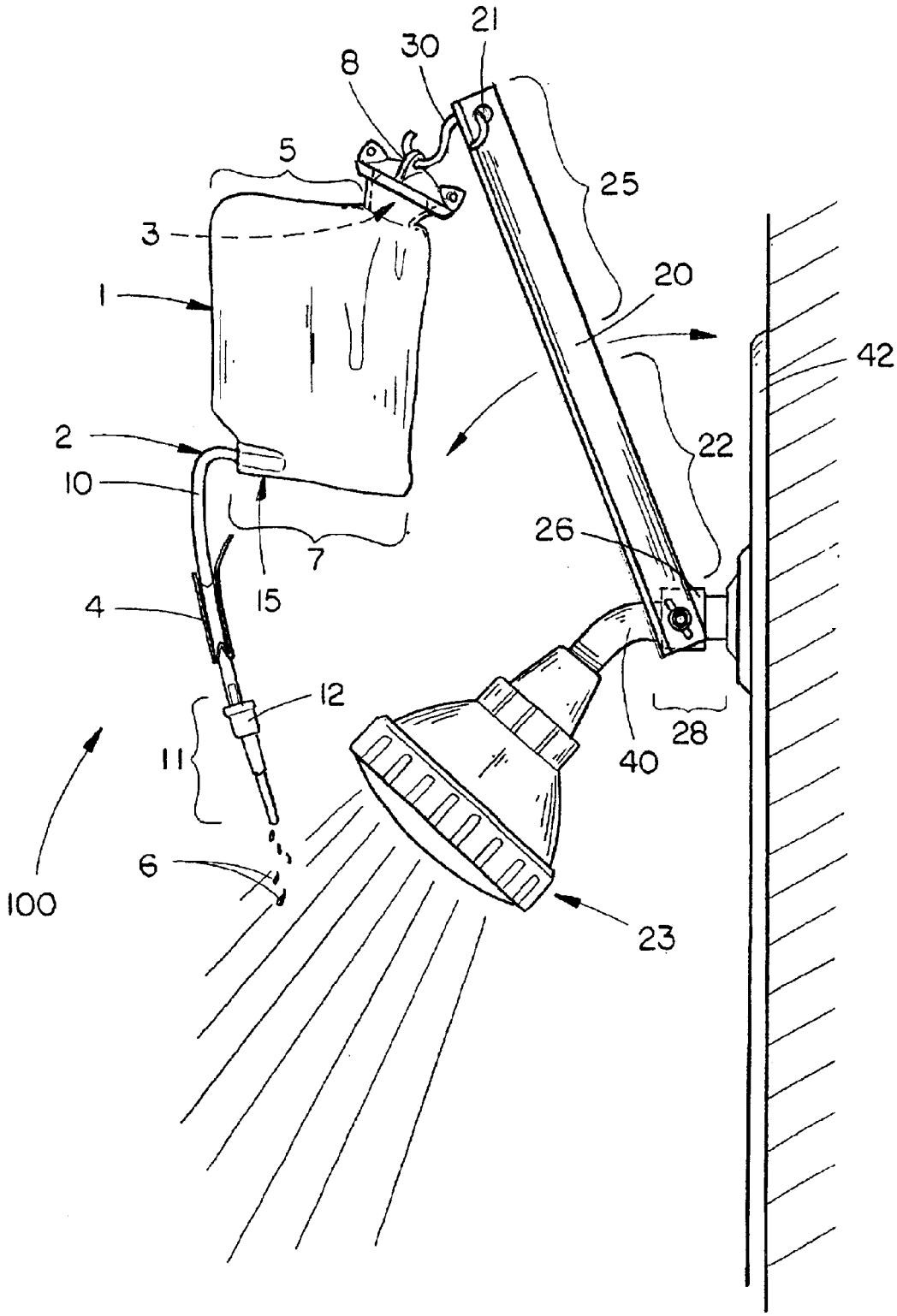
FIG. 1 shows the liquid additive dispensing apparatus of the present invention according to a first embodiment.

Referring now to FIG. 1, there is shown a liquid additive dispensing apparatus 100 of the present invention. The liquid additive dispensing apparatus 100 comprises three main components, namely, an additive reservoir 1, an additive dispensing conduit 10, and a support 20 for supporting the additive reservoir 1. The support 20 is adapted for mounting on a shower structure, such as a water supply pipe 40 of a conventional shower fixture, a showerhead, a wall, a shower door or a shower curtain rod.

The additive reservoir 1 may be made of flexible or rigid materials. In the embodiment shown, the reservoir is a bag formed of a flexible plastic material of the type used for enteral bags. The reservoir material may be opaque but is preferably transparent or translucent to enable viewing the level of the liquid additive 6 in the additive reservoir 1. The reservoir 1 is shown having a generally rectangular configuration but can be round or cylindrical or have any other suitable configuration. At the upper portion 5 of the additive reservoir 1, there may be an opening 3 permitting introduction of liquid additive 6 into the additive reservoir 1. Alternatively, the liquid additive 6 may be introduced into the additive reservoir 1 by other means.

In another embodiment, the additive reservoir 1 may be divided into a plurality of separate dispenser compartments as a means of storing and dispensing additional or alternative liquid additives with each such compartment having a respective additive dispensing conduit, a respective opening, and a respective corresponding valve. It will be appreciated that the reservoir can be divided into any number of compartments.

An additive dispensing conduit 10 extends from the lower portion 7 of the additive reservoir 1 to a terminal end 11 and is in communication with the additive reservoir 1 such that liquid additive 6 in the additive reservoir 1 will flow by gravity into the additive dispensing conduit 10. The additive dispensing conduit 10 is tubular and has an inside bore sufficiently large so as to permit the free flow of liquid additive 6, by gravity alone, from the additive reservoir 1 through the additive dispensing conduit 10. The additive dispensing conduit 10 may be made of flexible or rigid materials. In the embodiment shown, the terminal end of the additive dispensing conduit 10 includes a tubular adapter 12 with an inside bore sufficiently large so as to permit the free flow of liquid additive 6, by gravity alone. Further in the embodiment shown, the conduit is made of flexible plastic material of the type used with enteral bags, but can be made of metal or any other suitable material. In another embodiment, the conduit may be a bendable and reshapable material to permit positioning of the conduit such that the liquid additive 6 may be dispensed from the terminal end 11 of the conduit 10, into, above or adjacent to the shower stream emitted from the shower head.

In one embodiment, the additive dispensing conduit 10 may be removably attached to the additive reservoir 1 by means of a separate or integral coupler 15, such that the additive dispensing conduit 10 is replaceable with another of the same or different inside diameter or material. Alternatively, the coupler 15 may be a cover or screw cap integral with the additive dispensing conduit 10 of the dispenser type used with condiment containers. The coupler 15 may be a sleeve or tubular member extending from an opening in the reservoir to fit concentrically around or within the proximal end 2 of the conduit 10. Replacement of the additive dispensing conduit 10 with one of larger or smaller inside diameter may be performed using the coupler 15 in order to dispense a more or less viscous liquid additive or to more or less rapidly dispense the liquid additive 6. Alternatively, the additive dispensing conduit 10 may be permanently affixed to the reservoir.

The additive dispensing conduit 10 includes a valve 4 which may be any type of valve capable of controlling the flow of a liquid additive through the conduit. For example, the valve 4 may be a variable valve, such as a roller or screw valve, which permits selection of variable flow rates of liquid additive 6 through the additive dispensing conduit 10. In another embodiment, the valve 4 may only be capable of on and off positions. Examples of suitable valves include stopcock valves, ball valves, piston valves, rotary valves and even clamps.

The support 20 includes a proximal portion 22 and a distal portion 25. The configuration and positioning of the support 20 is such that the liquid additive 6 may be dispensed from the terminal end 11 of the conduit 10 into, above or adjacent to the shower stream emitted from the shower head 23 and such that the liquid additive first mixes with the shower stream downstream from and after it is emitted from the shower head. The proximal portion 22 may be attached by a mount 26 to a shower structure, such as the water supply pipe 40, the wall 42, the shower door, the shower curtain rod, or any other suitable support structure in the shower. In the embodiment shown, the support 20 is a straight arm that extends adjustably upward and forward from the mount 26. Alternatively, the support 20 may be an arm that extends vertically upward from the mount 26 and bends forwardly to position the additive reservoir 1.

The distal portion 25 of the support 20 may be attached to the additive reservoir 1. In one embodiment, the distal portion 25 of the support 20 includes a receptacle 21 which permits removable attachment to an attachment 8 on the upper portion 5 of the additive reservoir 1. In the embodiment shown, the receptacle is an aperture or eyelet formed in the distal portion 25 of the support 20 and the additive reservoir 1 is shown removably attached to the distal portion 25 of the support 20 by means of an optionally separate, hook 30. In another aspect of this embodiment, the receptacle 21 may be a hook or curved portion at the distal end 25 of the support 20 that receives a handle type attachment.

In use, the attachment 8 of the additive reservoir 1 is attached to the receptacle 21 at the distal portion of the support 20. The desired liquid additive 6 may be added through the opening 3 in the upper portion 5 of the additive reservoir 1 before or after the additive reservoir 1 is attached to the support 20. The support 20 may be configured and/or its position adjusted so that the liquid additive 6 may be dispensed from the additive dispensing conduit 10 into or adjacent to the shower stream emitted from the shower head 23. In use, liquid additive 6 may be dispensed independent of the shower water and not through the shower head 23. If a person taking a shower desires to have the liquid additive 6 in the additive reservoir 1 dispensed into the shower stream emitted from the shower head 23, then the person may engage the valve 4 of the additive dispensing conduit 10. As a result, the liquid additive 6, for example soap, flows by gravity alone through the conduit 10, is dispensed into and contacts the shower stream downstream of the shower head, after it is emitted from the shower head, and mixes into the shower water; thereby soapy shower water is sprayed directly onto the person showering. When the person wishes to rinse off the soap, the valve 4 may be disengaged.

Alternatively, the liquid additive dispensing apparatus 100 may be positioned so that the liquid additive 6 is dispensed outside of the shower stream and moves by gravity to mix with the shower water downstream of the shower head.

Alternatively, the liquid additive dispensing apparatus 100 of the present invention may be used when the source water supply is turned off.

The liquid dispensing apparatus may include one or more adjustment mechanism 28 adapted for positioning of the additive reservoir 1 such that the liquid additive 6 may be dispensed from the terminal end 11 of the conduit 10 into, above or adjacent to the shower stream emitted from the shower head 23 and the liquid additive 6 may first mix with the shower stream downstream from and after it is emitted from the shower head 23. The adjustment mechanism may be of any type, including one that may be operated manually.

In the embodiment shown, the additive reservoir 1, additive dispensing conduit 10 and valve 4 are made from a conventional enteral bag which may be suspended from the support 20.

Figure 2:
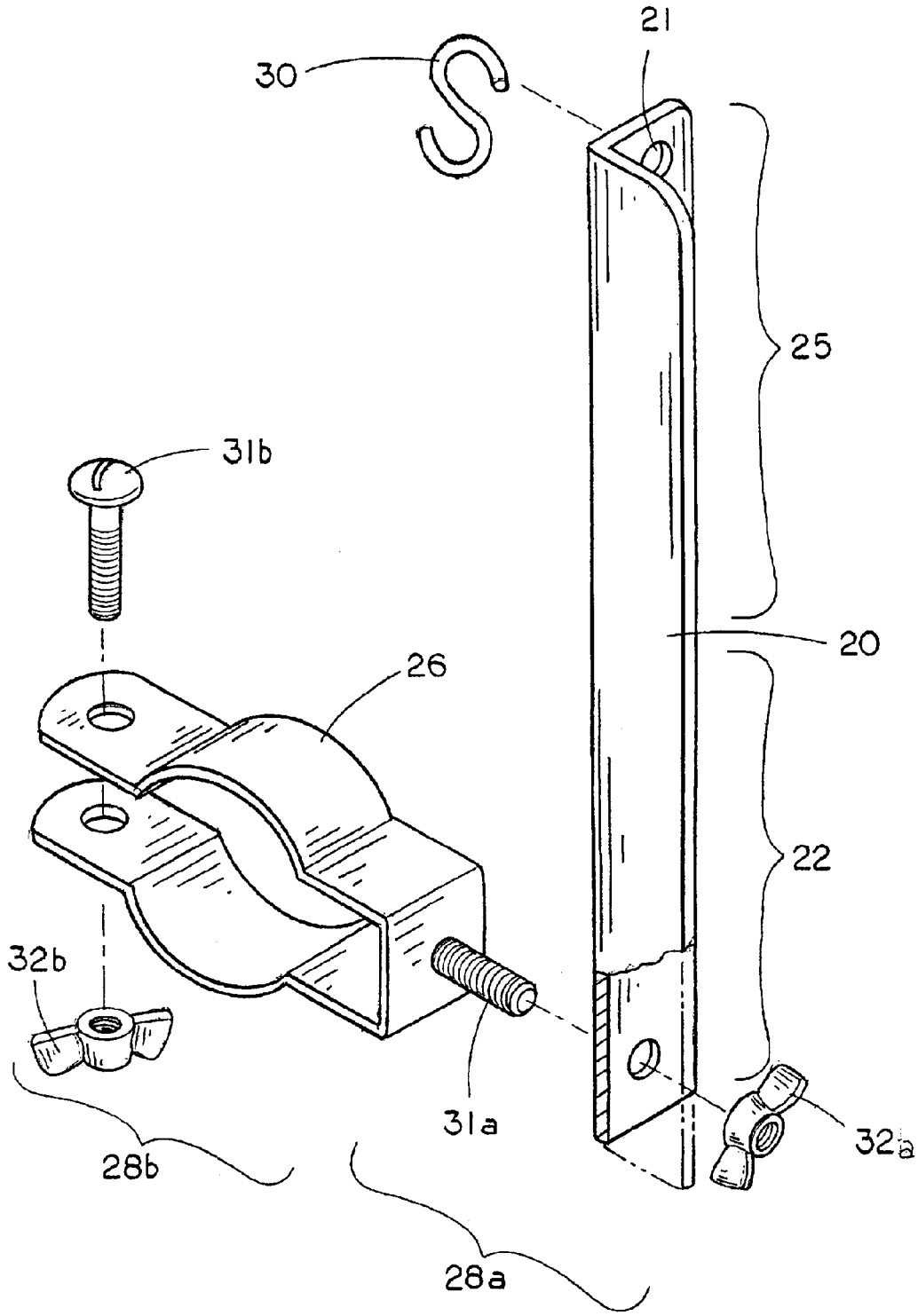
FIG. 2 shows further details of the embodiment of FIG. 1.

Referring now to FIG. 2 there is shown further details of portions of the liquid additive dispensing apparatus of FIG. 1. In the embodiment shown, the liquid additive dispensing apparatus includes two adjustment mechanisms 28*a* and 28*b*. The support 20 is a straight arm which is attached to the mount 26 and the one adjustment mechanism 28*a* is a bolt 31*a* with nut 32*a* which may be manually loosened and retightened to permit positioning of the additive reservoir 1 by changing the position of the support 20 to raise or lower the additive reservoir 1. The second adjustment mechanism 28*b* is a bolt 31*b* with nut 32*b* on the mount 26 which can be loosened and retightened to permit positioning of the additive reservoir 1 by rotation of the mount 26 on the water supply pipe 40. The mount 26 may be of any suitable type adapted for mounting the support 20 on the shower structure, such as a clamp, a bracket, a suction cup, or adhesives. Alternatively, the adjustment mechanism may be a swivel joint, whereby the support 20 may rotate with respect to mount 26 or the shower structure, to permit essentially lateral or vertical movement of the support 20. The swivel joint may permit rotation of the additive reservoir with respect to the proximal portion 22 of the support 20. In another embodiment, the mount 26 is integral with the proximal portion of the support 20 and is adapted to mount on a shower structure and the adjustment mechanism 28 permits relocation of the support 20 on the shower structure, for example, the adjustment mechanism may be a screw clamp. In another embodiment, one or more of the mount 26, the proximal portion 22 of the support 20, and the adjustment mechanism 28 may be a substantially hollow structure to permit telescoping of the support 20. In a further embodiment, the support 20 may be a bendable and reshapable material to permit the desired positioning.

To summarize some of the significant features of the present invention, it is to be noted that the liquid additive dispensing apparatus is easy to install. The apparatus does not require integration with the shower head or retro-fitting or modification of existing plumbing installations. The apparatus does not require diversion of shower water, nor does it otherwise interfere with the flow of water to the shower head. Further, it will be noted that the overall function of the liquid additive dispensing apparatus is quite simple relative to most other devices.

Use of the liquid additive dispensing apparatus of the present invention does not rely on venturi effect or siphonic action to effect mixing of liquid additive with the shower water and avoids the need for check valves to prevent shower water entering the liquid additive container and thus overcomes problems of reduced shower water flow and back pressure that have been problems with other soap dispensing devices. Additionally, as the liquid additive mixes with the shower water downstream of the shower head, the present invention avoids the clogging of internal valves or shower head openings with soap, as is prevalent with other devices.

While the invention has been disclosed in detail above, the invention is not intended to be limited strictly to the invention as disclosed. It is evident that those skilled in the art may now make numerous uses and modifications of and departures from the specific embodiments described herein without departing from the inventive concepts. For example, the various components of the specific embodiments described herein can be interchanged.

What is claimed is:

1. A liquid additive dispensing apparatus adapted for dispensing a liquid additive into, above or adjacent to a shower stream emitted from a shower head, comprising:

a hanging additive reservoir including an upper portion and a lower portion;

an additive dispensing conduit extending from said additive reservoir, said additive dispensing conduit including a proximal end and a terminal end and a valve means;

a support means for hanging said additive reservoir in relation to the shower head such that liquid additive dispensed from said terminal end of said conduit will first mix with said shower stream downstream of said shower head, said support means including a proximal portion and a distal portion, wherein said distal portion is attached to said upper portion of said hanging additive reservoir and wherein said proximal portion includes a mounting means adapted for mounting said support means to a shower structure, and wherein said hanging additive reservoir further comprises an attachment means on said upper portion for removably attaching said additive reservoir to a receptacle on said distal portion of said support means of a hook.

2. The liquid additive dispensing apparatus of claim 1, wherein said additive dispensing conduit is flexible and extends from said lower portion of said additive reservoir.

3. The liquid additive dispensing apparatus of claim 1, wherein an opening is defined in said upper portion of said additive reservoir to permit introduction of said liquid additive into said additive reservoir.

4. The liquid additive dispensing apparatus of claim 1, wherein said additive reservoir is at least partially made of a transparent material.

5. The liquid additive dispensing apparatus of claim 1, wherein said upper portion of said additive reservoir is removably attached to said distal portion of said support means.

6. The liquid additive dispensing apparatus of claim 1, wherein said valve means comprises a valve with on and off positions.

7. The liquid additive dispensing apparatus of claim 1, wherein said valve means comprises a variable valve.

8. The liquid additive dispensing apparatus of claim 1, further comprising an adjustment mechanism adapted for adjustably positioning said additive reservoir, whereby said liquid additive dispensed from said additive dispensing conduit may enter or gravitate into said shower stream.

9. The liquid additive dispensing apparatus of claim 8, wherein said mounting means is a clamp, said support means comprises an arm that extends from said mounting means and said adjustment mechanism is one or more bolt with nut on the mounting means which may be loosened and retightened to permit positioning of said support means.

10. The liquid additive dispensing apparatus of claim 8, wherein said adjustment mechanism is a swivel joint.

11. The liquid additive dispensing apparatus of claim 1, wherein said support means is bendable and reshapable.

12. The liquid additive dispensing apparatus of claim 1, wherein said additive dispensing conduit has a bore of predetermined size, as determined by the viscosity of said liquid additive to be dispended, which is large enough to allow dispending of said liquid additive by gravity alone.

13. The liquid additive dispensing apparatus of claim 1, wherein said additive reservoir comprises a plurality of additive compartments, wherein each of said additive compartments includes a corresponding additive dispensing conduit and valve means.

14. The liquid additive dispensing apparatus of claim 1, wherein said additive reservoir, said additive dispensing conduit, and said valve means comprise an enteral bag.

15. A method of dispensing a liquid additive into, above or adjacent to a shower stream emitted from a shower head such that said liquid additive first mixes with said shower stream downstream of said shower head, said method comprising:

hanging an additive reservoir from a support means with a hook;

attaching said support means to a shower structure by a mounting means adapted for mounting to a shower structure;

positioning an additive dispensing conduit such that it extends from the additive reservoir to a position in, above or adjacent to the shower stream emitted by said shower head; and engaging a valve in said additive dispensing conduit so as to dispense a liquid additive.

16. The method of claim 15, wherein said additive reservoir is removably hung from said distal portion of said support means.

17. The method of claim 15, wherein said additive dispensing conduit is flexible and has a bore of predetermined size, as determined by the viscosity of said liquid additive to be dispensed, which is large enough to allow dispensing of said liquid additive by gravity alone.

18. The method of claim 15, wherein said additive reservoir, said additive dispensing conduit, and said valve means comprise an enteral bag.

19. The method of claim 15, whereby said liquid additive is dispensed by gravity alone.

20. A liquid additive dispensing apparatus adapted for dispensing a liquid additive into, above or adjacent to a shower stream emitted from a shower head, comprising:

an additive reservoir including an upper portion and a lower portion;

an additive dispensing conduit extending from said additive reservoir, said additive dispensing conduit including a proximal end and a terminal end and a valve means;

a support means for supporting said additive reservoir in relation to the shower head such that liquid additive dispensed from said terminal end of said conduit will first mix with said shower stream downstream of said shower head, said support means including a proximal portion and a distal portion, wherein said distal portion is attached to said additive reservoir and wherein said proximal portion includes a mounting means adapted for mounting said support means to a shower structure; and said additive reservoir further comprising an attachment means on said upper portion for removably attaching said additive reservoir to a receptacle on said distal portion of said support means by means of a hook.

21. A hanging liquid additive dispensing apparatus for adding a liquid additive to a shower stream, comprising:

a hanging additive reservoir including an upper portion and a lower portion;

a conduit extending from said lower portion of said hanging additive reservoir; said conduit having a proximal end and a terminal end;

a support having a proximal and distal portion; said proximal portion being adjustably, removably secured to a shower structure; said upper portion of said hanging additive reservoir being adjustably, removably suspended from said distal portion of said support to thereby position said terminal end of said conduit into, above or adjacent said shower stream; and wherein said hanging additive reservoir further comprises an attachment means on said upper portion for removably attaching said additive reservoir to a receptacle on said distal portion of said support means by means of a hook.

* * * * *